US007980189B2

(12) United States Patent
Zampiello et al.

(10) Patent No.: US 7,980,189 B2
(45) Date of Patent: Jul. 19, 2011

(54) METHODS AND APPARATUS FOR A SCUTTLE MECHANISM

(75) Inventors: Albert N. Zampiello, Boxboro, MA (US); Joseph A. Frassa, Billerica, MA (US)

(73) Assignee: Raytheon Company, Waltham, MA (US)

( * ) Notice: Subject to any disclaimer, the term of this patent is extended or adjusted under 35 U.S.C. 154(b) by 218 days.

(21) Appl. No.: 12/512,328

(22) Filed: Jul. 30, 2009

(65) Prior Publication Data

US 2010/0024703 A1 Feb. 4, 2010

Related U.S. Application Data

(60) Provisional application No. 61/085,218, filed on Jul. 31, 2008.

(51) Int. Cl.
*B63B 13/00* (2006.01)

(52) U.S. Cl. ..... 114/198

(58) Field of Classification Search ..... 114/197, 114/198; 441/95
See application file for complete search history.

(56) References Cited

U.S. PATENT DOCUMENTS 3,308,046 A * 3/1967 Suleski ..... 114/198
4,004,533 A 1/1977 Woolston
4,498,491 A * 2/1985 Chamberland et al. ..... 137/72
4,846,209 A * 7/1989 Martini ..... 114/198
5,951,346 A 9/1999 Woodall, Jr.
6,766,745 B1 7/2004 Kuklinski et al.
7,345,705 B2 3/2008 Croasdale

OTHER PUBLICATIONS

Notification Concerning Transmittal of International Preliminary Report on Patentability (Chapter 1 of the Patent Cooperation Treaty), PCT/US2009/052216, date of mailing Feb. 10, 2011, 2 pages.
Written Opinion of the International Searching Authority, PCT/US2009/052216, date of mailing Feb. 10, 2011, 4 pages.
Notification of Transmittal of the International Search Report and the Written Opinion of the International Searching Authority, or the Declaration, PCT/US2009/052216, dated Sep. 14, 2010, 4 pages.
Written Opinion of the International Searching Authority, PCT/US2009/052216, dated Sep. 14, 2010, 5 pages.

* cited by examiner

*Primary Examiner* — Lars A Olson
(74) *Attorney, Agent, or Firm* — Daly, Crowley, Mofford & Durkee, LLP

(57) ABSTRACT

Methods and apparatus for a scuttle assembly including an end member having a port to enable fluid flow, a valve member having a closed position to prevent fluid from flowing into a channel and an open position to allow fluid flowing into the channel, a bias member to bias the valve member to the open position, and a scuttle washer sandwiched between the end member and the valve member, the scuttle washer comprising a material that dissolves due to exposure to sea water without generating toxic gas or hydrogen.

19 Claims, 12 Drawing Sheets

| | |
|---|---|
| Outside diameter | 7.5 in |
| Inside diameter | 5.0 in |
| Length | 35.9 in |
| Inner and outer tube wall thickness | 0.1 in |
| Pass thru tube wall thickness | 0.125 in |
| Rib thickness | 0.125 in |

METHODS AND APPARATUS FOR A SCUTTLE MECHANISM

CROSS REFERENCE TO RELATED APPLICATIONS

The present application claims the benefit of U.S. Provisional Patent Application No. 61/085,218, filed on Jul. 31, 2008, which is incorporated herein by reference.

BACKGROUND

Devices launched by submarines or other vessels that are meant to rise to the ocean surface must at some point scuttle so as not to disclose the presence of the submarine, for example. Current scuttle technology employs metallic scuttle components that produce hydrogen gas when exposed to water. This presents an explosion hazard on board a submarine or other vessel. Prior attempts employ metallic washers that are hazardous and cannot withstand large hydrostatic pressures.

SUMMARY OF THE INVENTION

The present invention provides methods and apparatus for a scuttle mechanism that includes a washer component that dissolves with contact to sea water without generating toxic gas or hydrogen gas. The scuttle washer is sandwiched between a cap and a valve member so that a bias member pressures the valve member to the cap as the washer dissolves to enable water to flow into a device and ultimately scuttle the device. With this arrangement, a device can be reliably scuttled after a selected amount of time. While exemplary embodiments of the invention are primary shown and described in conjunction with certain applications, such as submarine launched vehicles (SLVs) to enable underwater communication, it is understood that the inventive scuttle mechanism is applicable to devices in general for which it is desirable to enable the flow of water a desired time after contact with water.

In one aspect of the invention, a scuttle assembly comprises an end member having a port to enable fluid flow, a valve member having a closed position to prevent fluid from flowing into a channel and an open position to allow fluid flowing into the channel, a bias member to bias the valve member to the open position, and, a scuttle washer sandwiched between the end member and the valve member, the scuttle washer comprising a material that dissolves due to exposure to sea water without generating toxic gas or hydrogen.

The assembly can further include one or more of the following features: the scuttle washer comprises a polymer, the scuttle washer comprises sugar, the scuttle assembly forms a part of a float assembly of a submarine launch vehicle, the end member is disposed in a cavity, the cavity having a generally ovular shape, the valve member include a series of legs to promote movement of the valve member and the scuttle washer along a longitudinal axis, the channel has a head portion that is wider than an inner portion, the valve member includes a series of apertures to allow water flow, the valve member includes an end having a boss, and the end member includes a depression to capture the boss when the scuttle washer is dissolved.

In another aspect of invention, a method comprises providing an end member having a port to enable fluid flow, providing a valve member having a closed position to prevent fluid from flowing into a channel and an open position to allow fluid flowing into the channel, providing a bias member to bias the valve member to the open position, and providing a scuttle washer sandwiched between the end member and the valve member, the scuttle washer comprising a material that dissolves due to exposure to sea water without generating toxic gas or hydrogen.

The method can further include one or more of the following features: the valve member include a series of legs to promote movement of the valve member and the scuttle washer along a longitudinal axis, the channel has a head portion that is wider than an inner portion, wherein the legs promote movement of the valve member along a longitudinal axis of the assembly as the valve member moves to the open position, the valve member includes a series of apertures to allow water flow, the valve member includes an end having a boss, and the end member includes a depression to capture the boss when the scuttle washer is dissolved.

In a further aspect of the invention, a submarine launch vehicle system comprises an inflatable bag, a buoy, and a float assembly comprising a scuttle mechanism including: an end member having a port to enable fluid flow, a valve member having a closed position to prevent fluid from flowing into a channel and an open position to allow fluid flowing into the channel, a bias member to bias the valve member to the open position, and a scuttle washer sandwiched between the end member and the valve member, the scuttle washer comprising a material that dissolves due to exposure to sea water without generating toxic gas or hydrogen.

BRIEF DESCRIPTION OF THE DRAWINGS

The foregoing features of this invention, as well as the invention itself, may be more fully understood from the following description of the drawings in which.

DETAILED DESCRIPTION

Exemplary embodiments of the invention employ a washer component that dissolves over time in sea water without producing toxic or hazardous gasses. Exemplary embodiments of the invention include a polymer component to keep a valve in the closed position until the polymer dissolves at which time the valve opens to allow the flow of water for scuttling of a device. The time it takes for the component to dissolve can be controlled by dimension and geometry. This allows the device to be on the surface long enough to perform a function and then scuttle leaving no visible trace.

Figure 1:
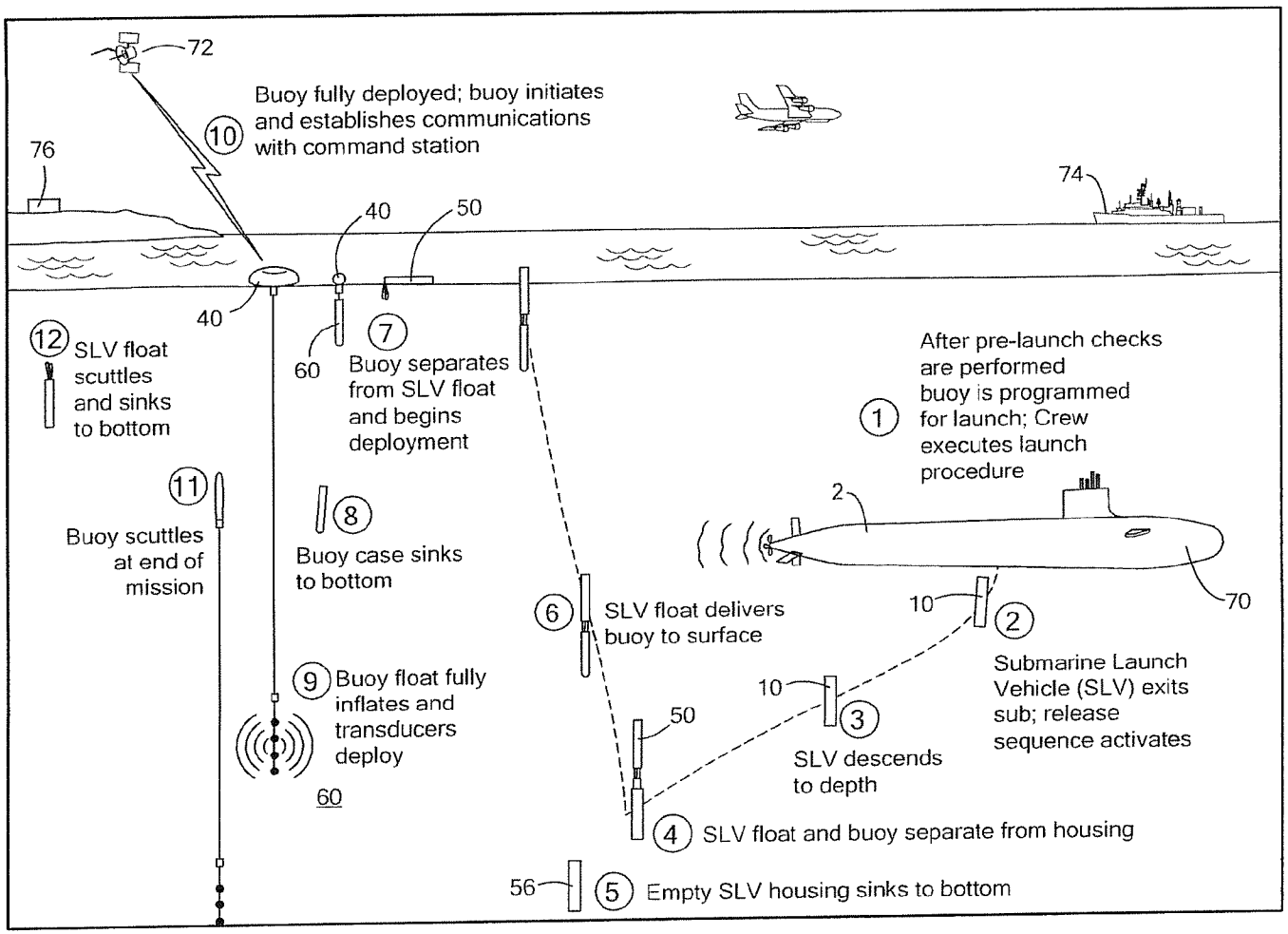
FIG. 1 is a pictorial representation of a submarine launch vehicle system including a float assembly having a scuttle mechanism in accordance with exemplary embodiments of the invention.

In an exemplary application shown in FIG. 1, a submarine launch vehicle (SLV) 10 is launched from a submarine 2 to provide paging capability via acoustic buoys that, when contacted via communications satellite, can send messages to submerged submarines. Acoustic messages can be sent at any time and received by the submarine without the need to come to periscope depth or deploy a towed antenna. Buoy transducer depth can be optimally chosen to maximize performance as a function of thermal layers and acoustic propagation characteristics.

Once the SLV 10 reaches its pre-programmed depth, a float assembly 50, carrying a buoy 60, is deployed from the SLV and the SLV housing 56 sinks. The buoy 60 and float assembly 50 separate from the SLV and ascend to the surface. The bag 40 inflates and remains on the surface while the float 50 assembly, which can be formed from aluminum, is released. The float assembly 50 includes a scuttle mechanism for scuttling the float assembly after a desired amount of time. The buoy 60 separates after which the buoy case sinks. Separation of the buoy 60 allows a transducer assembly to sink to a predetermined depth. After the initial communication link is established via the bag 40, the buoy 60 remains in standby mode for a selected amount of time while waiting for reception of a command via satellite instructing transmission of a message acoustically.

The float assembly 50 detached from a buoy 60 underwater beneath the bag 40. The float assembly 50 includes a scuttle mechanism in accordance with exemplary embodiments of the invention enabling the float assembly to scuttle after a desired amount of time. The SLV carrying the float assembly can be launched by a submarine 70, to enable communication between the buoy and a satellite 72. The satellite 72 can communicate with a first command station 74 onboard a ship, a second command station 76 based on land, and other command stations on land, sea or air. It is understood that a wide variety of SLV float assemblies can for various applications include an inventive scuttle mechanism to meet the needs of a particular application.

In one embodiment, after the float assembly 50 with the scuttle mechanism detaches from the buoy 60, a urethane float bag, shown as the ball 40 in FIG. 1, keeps the buoy in position during communication. When the mission is complete, in an illustrative embodiment, a resistor burns a hole in the urethane float bag 40. It is understood that the inflated float bag is not used to carry the buoy to the surface because of the hydrostatic pressure during ascent.

Figure 2:
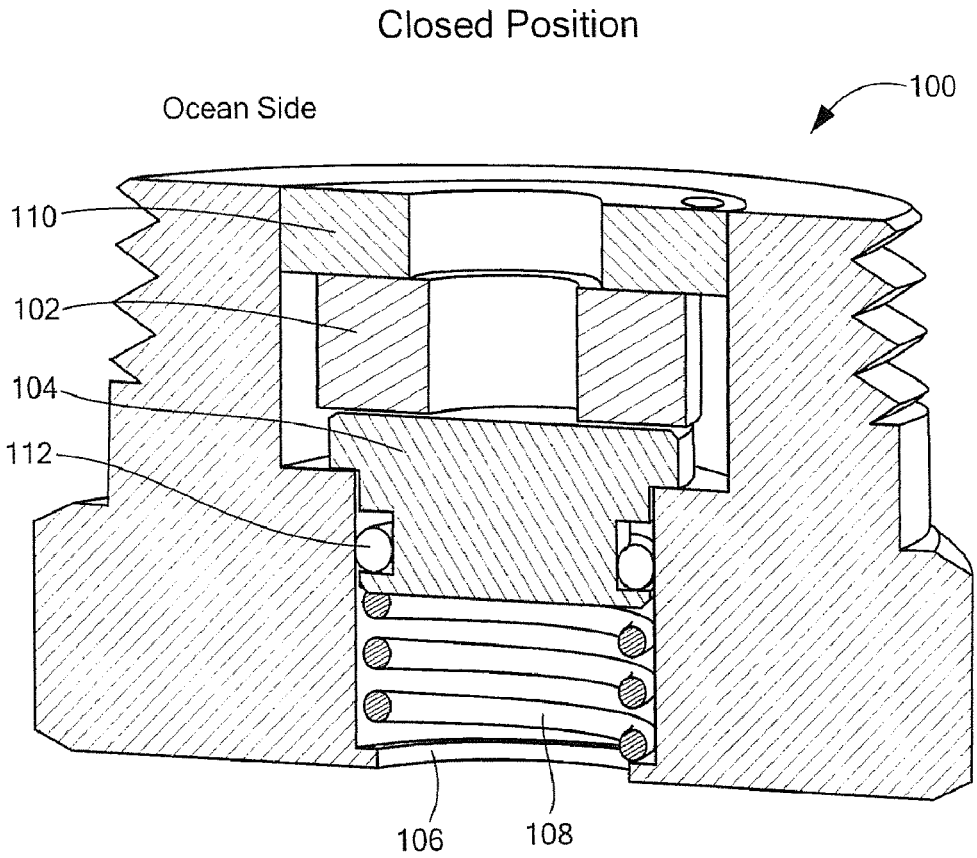
FIG. 2 is a side cut-away view of a scuttle mechanism in accordance with exemplary embodiments of the invention shown in a closed configuration.

FIG. 2 shows an exemplary scuttle mechanism 100 in the closed position. The scuttle washer 102, which can be provided as a polymer washer, secures a valve member/plug 104 in position so as to prevent the flow of water into a channel 106. A bias member 108, such as a spring, biases the valve member 104 away from the channel opening. An O-ring 112 provides a pressure seal between the valve member 104 and walls of the channel 106.

Figure 3:
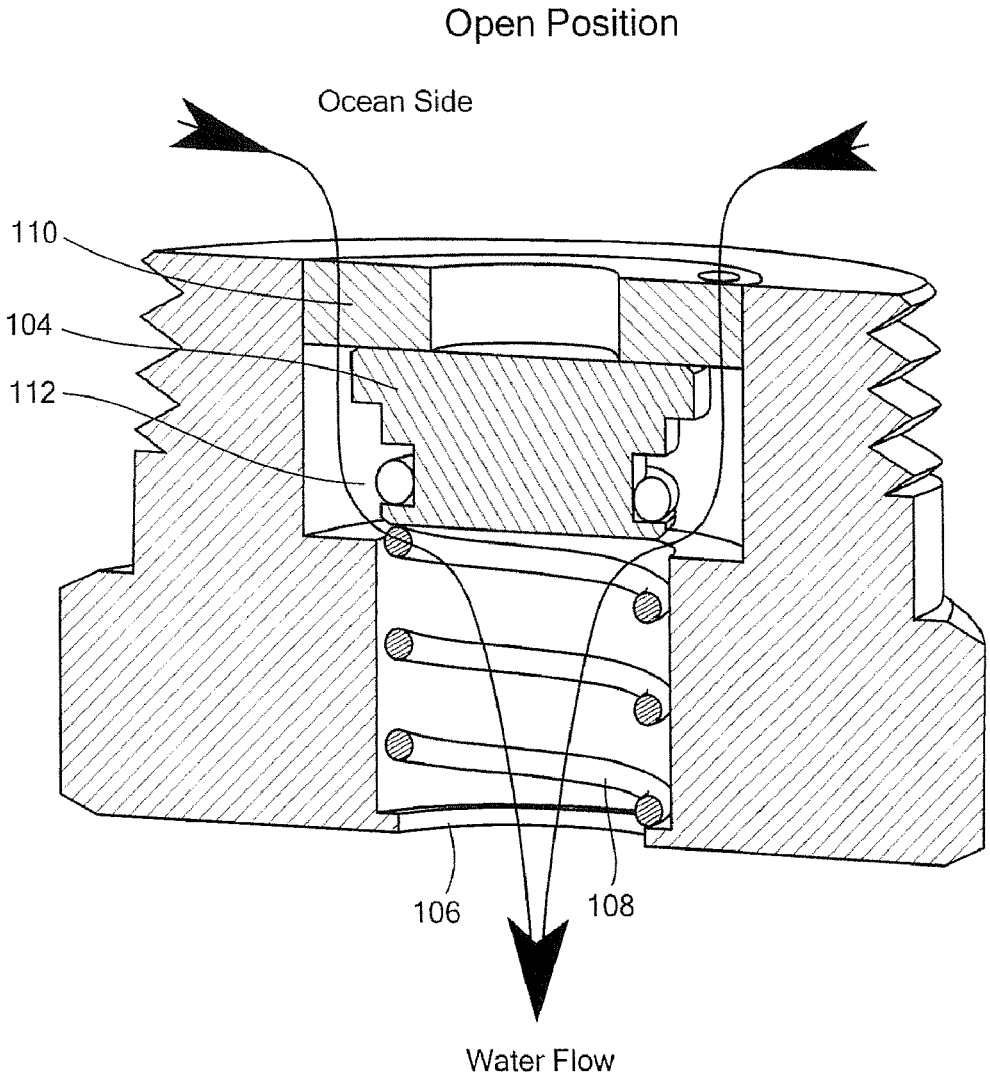
FIG. 3 is a side cut-away view of the scuttle mechanism of FIG. 4 shown in an open configuration to allow water flow.

FIG. 3 shows the scuttle mechanism 100 in the open position. After the washer 102 dissolves due to exposure to sea water via the ported end member or cap 110, the bias member 108 pushes the valve member out of the channel 106 to allow water to flow into the channel 106.

It is understood that the bias member 108 should have sufficient force to overcome the friction of the O-ring 112 and open the valve when the polymer washer 102 dissolves. However, the bias member 108 should not have an excessive level of force so that it compresses the polymer and partially opens the valve prematurely, e.g., before the float surfaces.

In an exemplary embodiment, the polymer washer is a cylindrical washer having partially hydrolyzed PVA between about 60-70% by volume and glass microballoons about 30-40% by volume. The PVA dissolves in water and the glass balloons provide the mechanical strength. In other embodiments, the scuttle washer is formed from a sugar-based material that dissolves in contact with water.

It is understood that the dimensions of the washer can vary to meet the needs of a particular application. In one embodiment, the washer is a cylinder about 0.3" high (thickness) and about 0.5" in diameter. It is understood that dissolution time can be adjusted by adjusting the thickness of the washer.

In an illustrative embodiment, the washer meets requirements 1) and 2) below after either conditions a) or b) where: a) 3 hour atmospheric pressure soak and a 20 minute water pressure exposure at 270 PSI using 3.6 weight percent salt water at a temperature of 35 degrees C.; and b) 3 minute atmospheric pressure soak and a 4 minute water pressure exposure at 270 PSI using 1.5 weight percent salt water at a temperature of −2 degrees C.

Requirement 1) The scuttle washers must not shrink in the axial dimension by more than 10% when (in the scuttle valve assembly) submerged in salt water for an atmospheric pressure soak, followed by the prolonged (20 min. or 4 min.) water pressure exposure at 270 PSI.

Requirement 2). After successful completion of requirement 1, the scuttle washer must dissolve so as to allow the scuttle valve to open when immersed in salt water at atmospheric pressure in the scuttle valve assembly. The maximum dissolution times for this test are 32.7 and 35.8 hours, for conditions (a) and (b) above, respectively.

Figure 4:
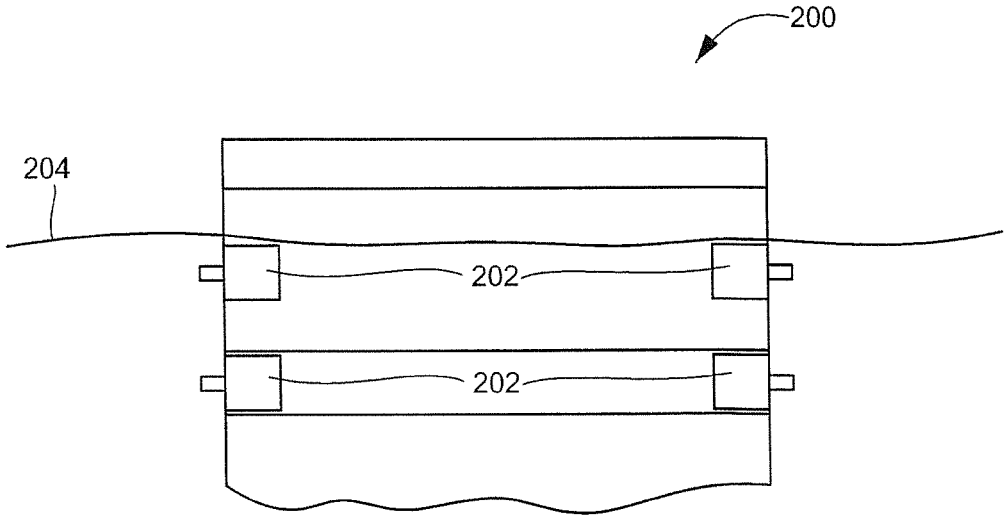
FIG. 4 is a schematic representation of a portion of a float assembly with multiple scuttle mechanisms.

In an exemplary embodiment shown in FIG. 4, an SLV float assembly 200 includes a number of scuttle mechanisms 202 one or more of which can be at, or below, the waterline 204. In one embodiment, the float is about 60 percent submerged when sealed and about 49 percent filled to sink the float. It understood that the scuttle washer material has to be wet to dissolve, so the float has to be weighted in such manner as to keep the scuttle washers underwater.

Figure 5:
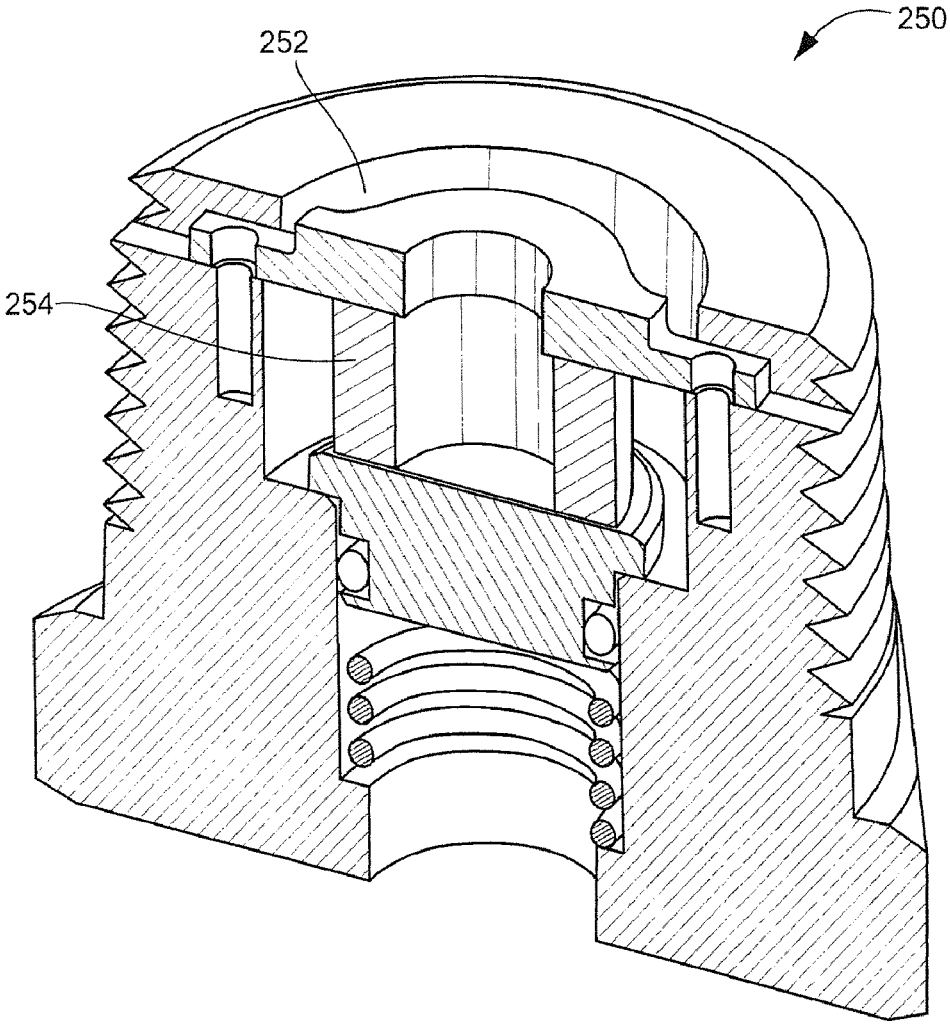
FIG. 5 is a cut-away view of a scuttle mechanism in accordance with further exemplary embodiments of the invention.

FIG. 5 shows a cut-away view of an exemplary scuttle mechanism 250 having vents 252 to promote contact between sea water and dissolvable scuttle washer 254 and enhance material removal as the washer dissolves. It is understood that sea conditions can alter the effective amount of contact between sea water and the dissolvable washer component. The vents 252 may also enhance removal of dissolving material to reduce the likelihood of the valve becoming clogged by washer material.

Figure 6A:
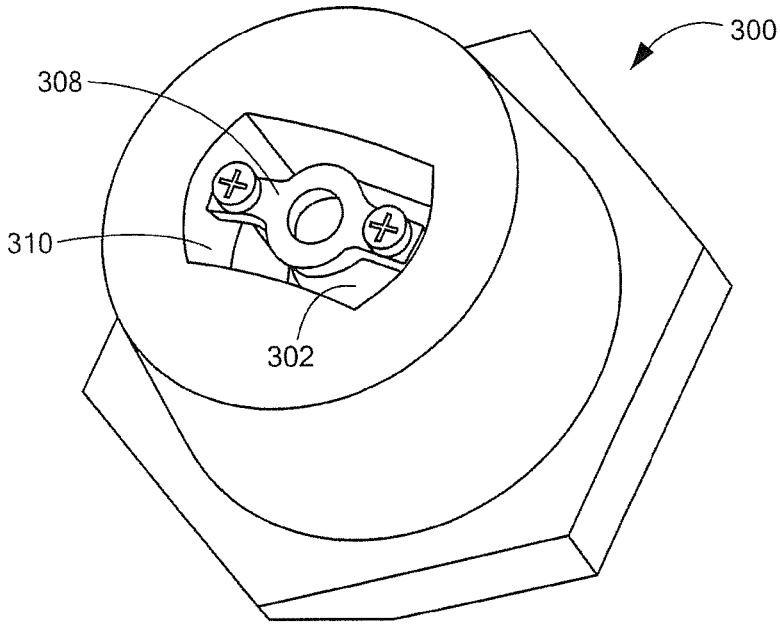
FIGS. 6A-6B are respective isometric and cut-away side views of a scuttle mechanism in accordance with other exemplary embodiments of the invention.
Figure 6B:
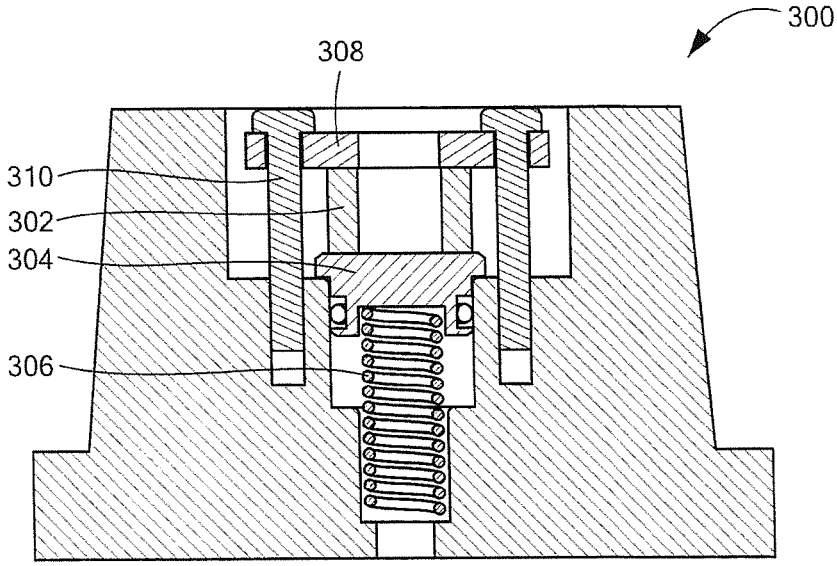

FIGS. 6A and 6B show a further embodiment of a scuttle mechanism 300 in accordance with exemplary embodiments of the invention. The scuttle mechanism 300 includes a dissolvable scuttle washer 302 abutting a valve member 304. A bias member 306 pressures the valve member 304 up against the washer 302. A cap 308 is secured in position in a cavity 310 bored in an end of an SLV. In the closed position, the washer 302 is sandwiched between the cap 308 and the valve member 304.

As the washer 302 dissolves, the bias member 306 pressures the washer toward the cap 308 to move the washer along a longitudinal axis of the scuttle mechanism. With this arrangement, the likelihood of the scuttle washer 302 moving off axis and becoming stuck in the cavity is reduced. As the washer dissolves, the valve member 304 moves into the cavity to allow water to enter and ultimately scuttle the float.

In addition, the cavity 310 is shaped to reduce the likelihood of material from the dissolving scuttle washer 302 from blocking the flow of water. More particularly, the cap retainer and cavity shape combine to prevent dissolving polymer material from clogging the valve. The polymer material may expand when dissolving. The cap retainer geometry allows the polymer to extrude out of the valve assembly as the polymer softens. The ovular shape of the cavity allows expansion more in one direction than the other, causing the dissolving washer to break apart more easily.

Figure 7A:
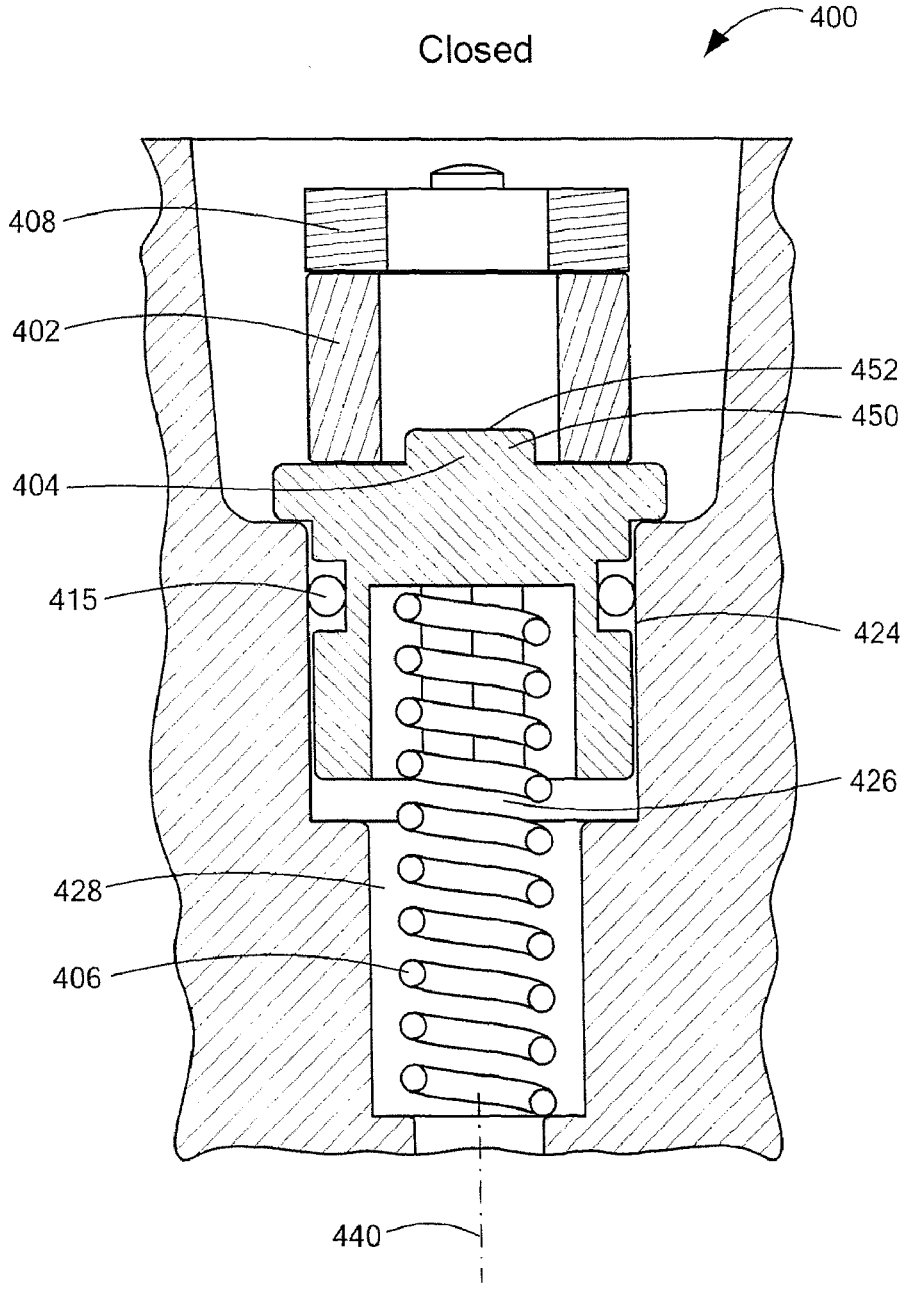
FIGS. 7A and 7B show cut-away views in respective closed and open configurations of a scuttle mechanism in accordance with further exemplary embodiments of the invention.
Figure 7B:
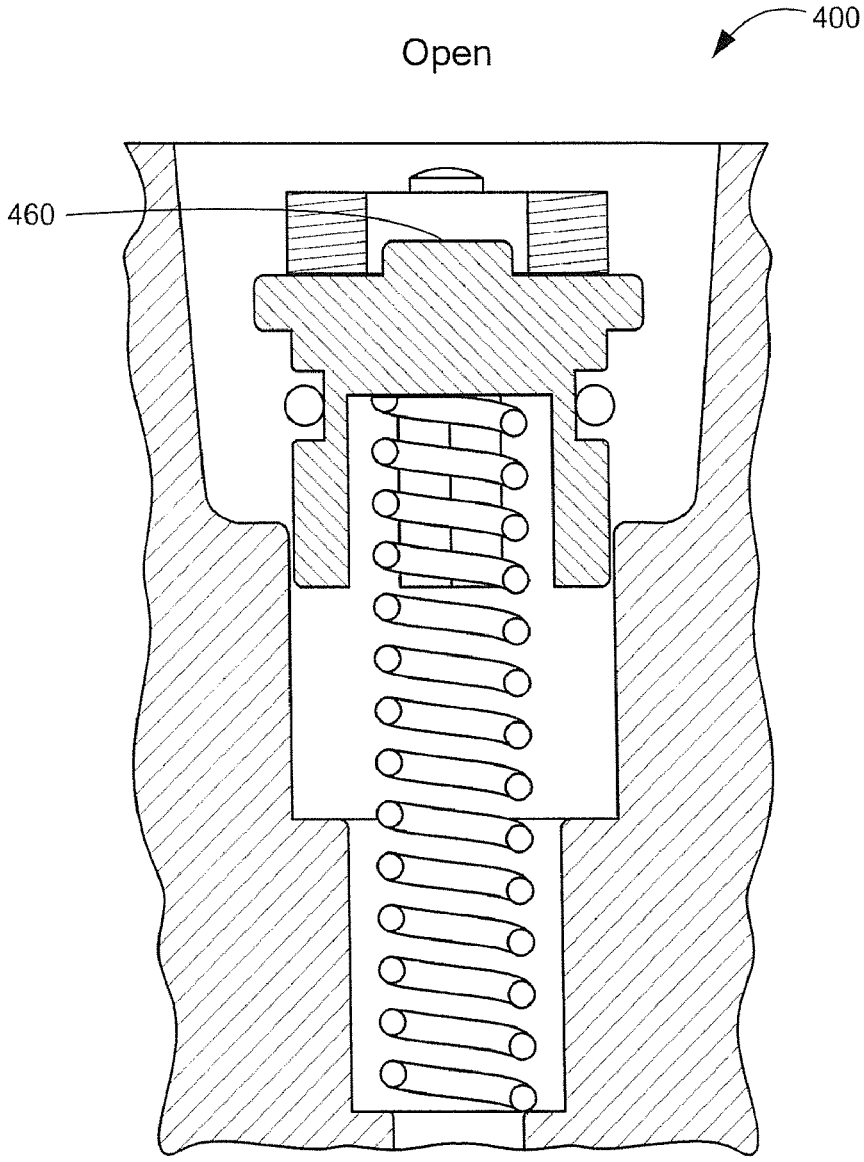
Figure 7C:
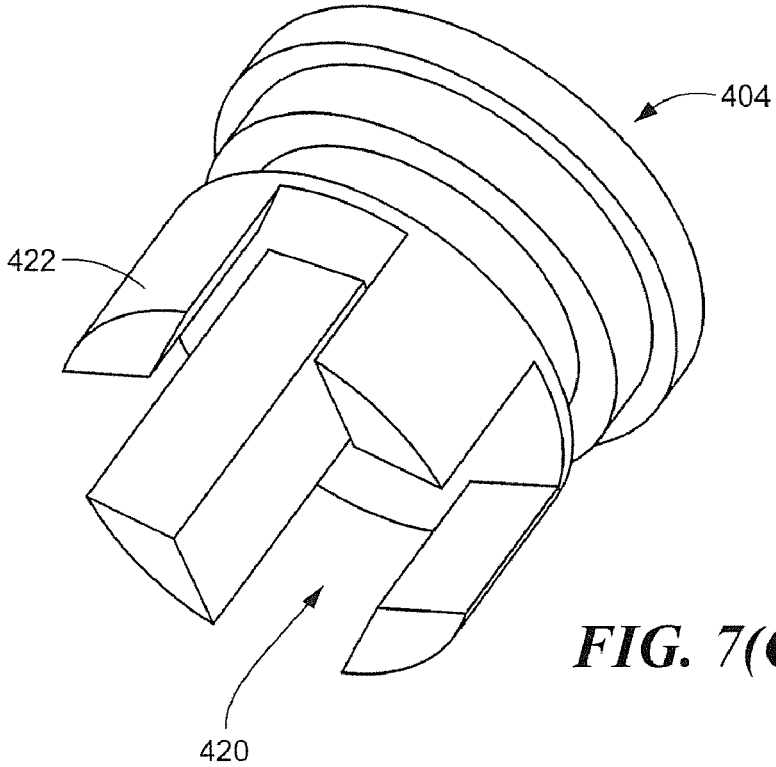
FIG. 7C shows an isometric view of a valve member that can form a part of the scuttle mechanism of FIGS. 7A and 7B.

FIGS. 7A-C show another embodiment of a scuttle mechanism 400 in accordance with exemplary embodiments of the invention. A dissolvable scuttle washer 402 is initially sandwiched between a cap 408 and a valve member 404. A bias member 406 pressures the valve member 404 against the washer 402 and the washer against a cap 408. An O-ring 415 can provide sealing.

Figure 7D:
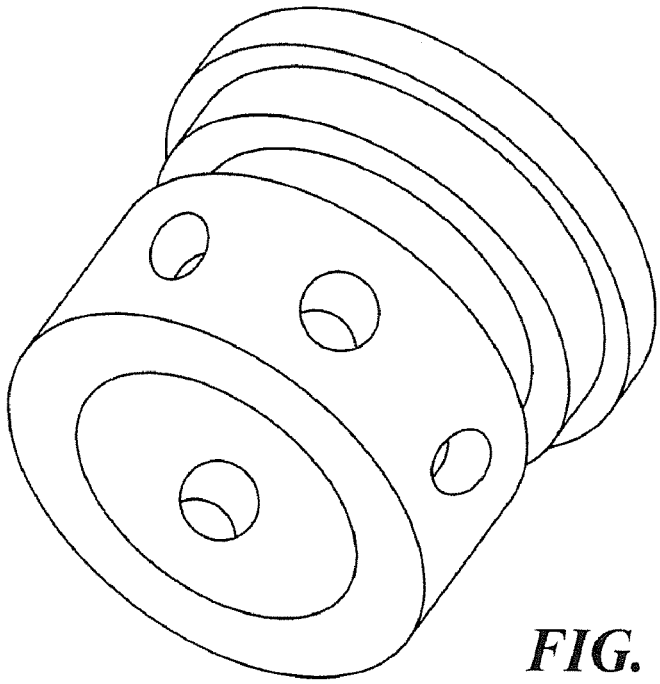
FIG. 7D shows an isometric view of an alternative embodiment of a valve member.

The valve member 404 includes a well 420 defined by a series of legs 422 into which an end of the bias member 406 extends. In an alternative body the legs 422 are replaced with a wall having apertures though which water can pass as shown in FIG. 7D. The valve member 404 fits in a head 424 of a channel 426 where the head has a wider opening than an inner portion 428 of the channel. With this arrangement, the legs 422 in the head 424 of the channel tend to move the valve member 404 along longitudinal axis 440 with minimal off axis movement.

In the illustrated embodiment, the valve member 404 includes a boss 450 extending into a complementary depression 452 in the washer 402. The boss/depression configuration maintains axial alignment of the valve member 404 and washer 402 as the thickness of the washer decreases moving the valve member toward the cap 408. In embodiment, the boss 450, after the washer 404 is dissolved, is captured by a depression 460 in the cap 408. It is understood that it is desirable to maintain the washer 404 centered in the cavity to promote graceful movement of the washer as it dissolves and prevent the washer from jamming.

Figure 8:
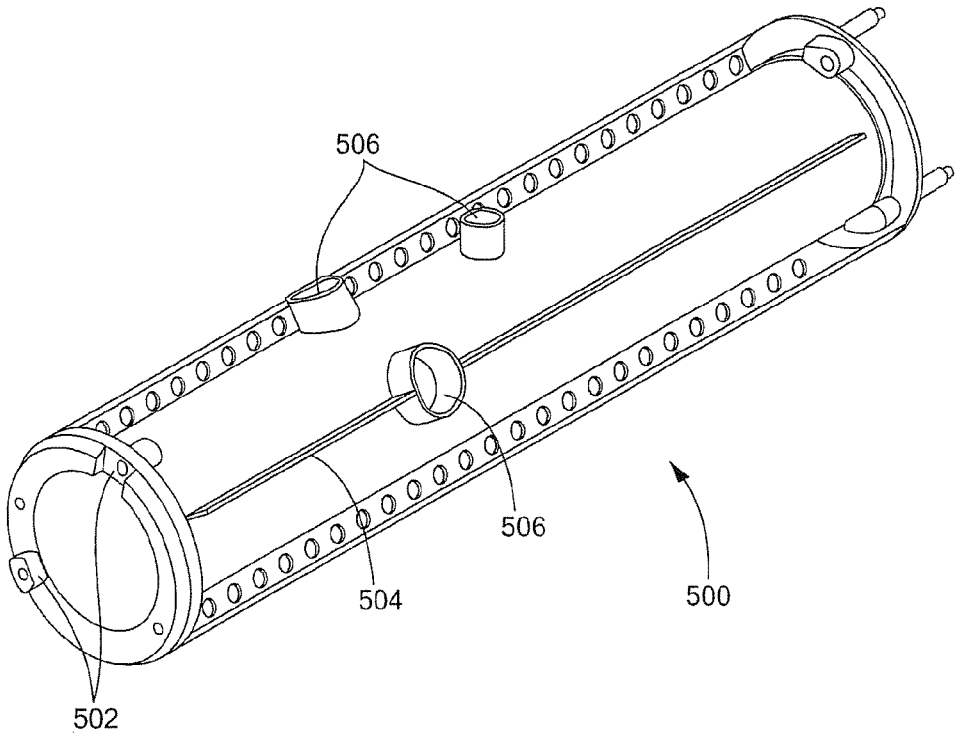
FIG. 8 is a schematic representation of a float having a scuttle mechanism in accordance with exemplary embodiments of the invention.

FIG. 8 shows further detail of an exemplary float assembly 500 having a scuttle mechanism in accordance with exemplary embodiments of the invention. As noted above, the float assembly brings the buoy to the surface after which the float assembly should scuttle. The illustrative float 500 includes two scuttle mechanisms 502 on each end.

The float 500 is formed from aluminum in one embodiment. Other suitable materials will be readily apparent to one of ordinary skill in the art. Ribs 504 provide strength to the float for structural integrity in the presence of significant hydrostatic pressures which can be present after launch from a submarine. The float can also include a desired number of pass through pipes 506 having selected diameters.

The ribs 504 in the float are required to meet the hydrostatic pressure requirement during ascent and descent and the holes in the ribs allow water to fill all four quadrants as it sinks since all quadrants need to be flooded for the float to sink. Exemplary dimensions for the float are shown.

The float 500 sits in the water in the horizontal position while it fills with water. A few seconds before sinking, the float rotates vertically. The scuttle valves 502 are located on both ends of the float so that air can escape the top valves, as water enters the bottom valves. This configuration hastens the scuttling process in relatively calm water.

Figure 9A:
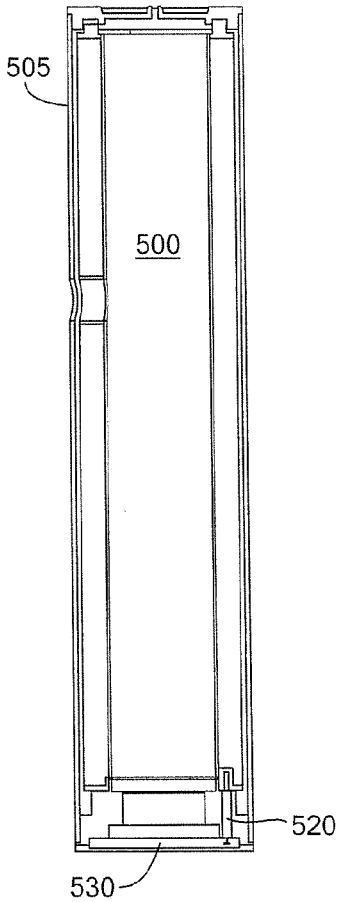
FIGS. 9A-C show a sequence of a float releasing from an SLV.
Figure 9B:
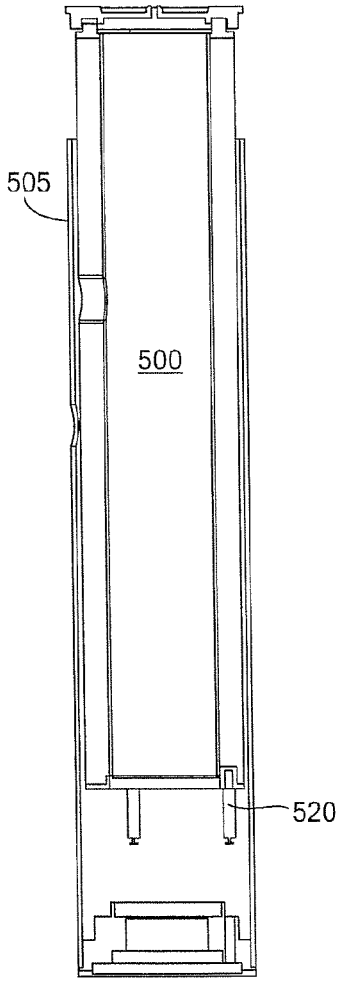
Figure 9C:
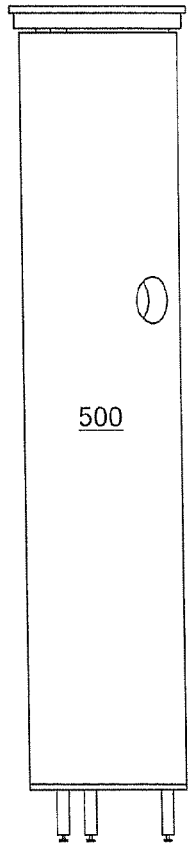

FIG. 9 shows a float being released from an SLV. Initially, the float 500 is captured by an SLV tube as shown in FIG. 9A. In one embodiment, a retaining pin 520 secures the float to a base 530 of the SLV. As shown in FIG. 9B, after release of the retaining pin 520, the float begins to slide out of the SLV tube until the float is free of the SLV, as shown in FIG. 9C.

Figure 10:
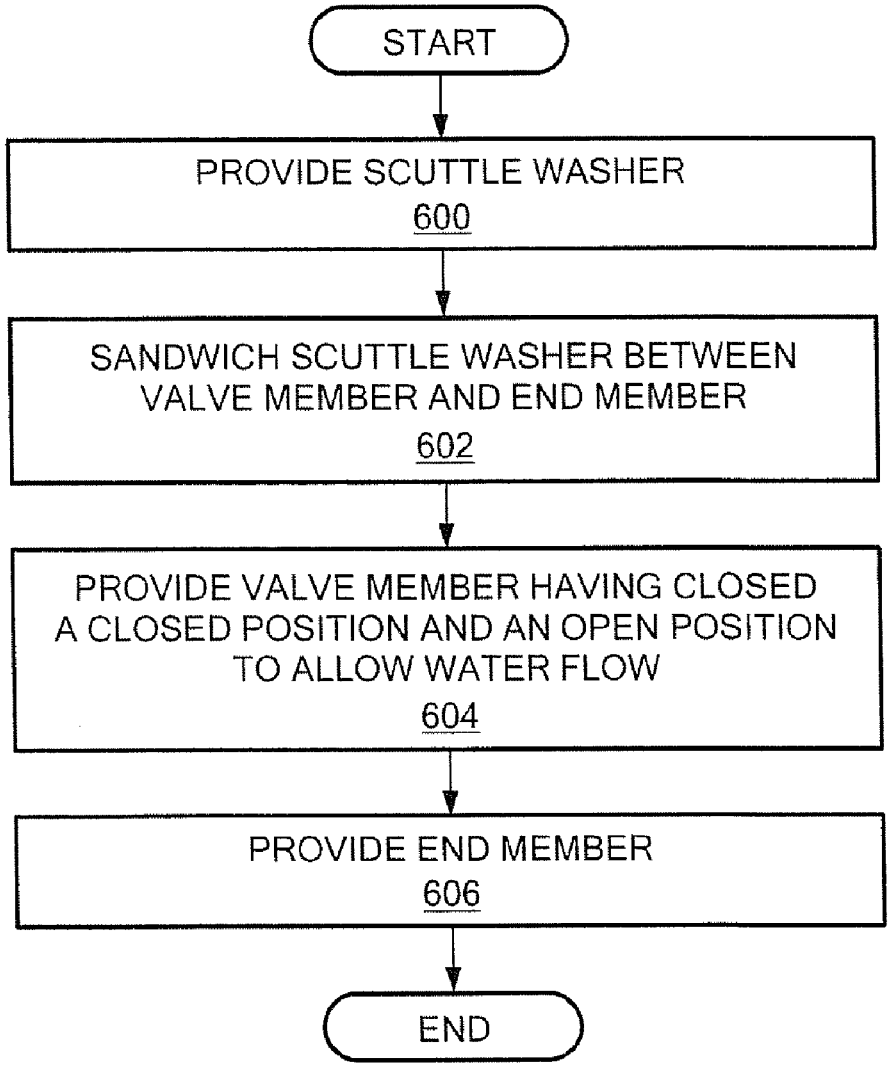
FIG. 10 is a flow diagram showing an exemplary sequence of steps to provide a scuttle mechanism in accordance with exemplary embodiments of the invention.

FIG. 10 shows a flow diagram for providing an exemplary sequence of steps for providing a scuttle mechanism in accordance with exemplary embodiments of the invention. In step 600, a dissolvable scuttle washer is provided. In step 602, the scuttle washer is sandwiched between an end member and a valve member. In exemplary embodiments, the scuttle washer comprises a material that dissolves due to exposure to sea water without generating toxic gas or hydrogen. In step 604, a valve member is provided having a closed position to prevent fluid from flowing into a channel and an open position to allow fluid flowing into the channel. In step 606, an end member is provided having a port to enable fluid flow.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A scuttle assembly, comprising:

an end member having a port to enable fluid flow;

a valve member having a closed position to prevent fluid from flowing into a channel and an open position to allow fluid flowing into the channel;

a bias member to bias the valve member to the open position; and a scuttle washer sandwiched between the end member and the valve member, the scuttle washer comprising a material that dissolves due to exposure to sea water without generating toxic gas or hydrogen.

2. The assembly according to claim 1, wherein the scuttle washer comprises a polymer.

3. The assembly according to claim 1, wherein the scuttle washer comprises sugar.

4. The assembly according to claim 1, wherein the scuttle assembly forms a part of a float assembly of a submarine launch vehicle.

5. The assembly according to claim 1, wherein the end member is disposed in a cavity, the cavity having a generally ovular shape.

6. The assembly according to claim 1, wherein the valve member include a series of legs to promote movement of the valve member and the scuttle washer along a longitudinal axis.

7. The assembly according to claim 6, wherein the channel has a head portion that is wider than an inner portion, wherein the legs promote movement of the valve member along a longitudinal axis of the assembly as the valve member moves to the open position.

8. The assembly according to claim 1, wherein the valve member includes a series of apertures to allow water flow.

9. The assembly according to claim 1, wherein valve member includes an end having a boss.

10. The assembly according to claim 9, wherein the end member includes a depression to capture the boss when the scuttle washer is dissolved.

11. A method of providing a scuttle assembly, comprising:

providing an end member having a port to enable fluid flow;

providing a valve member having a closed position to prevent fluid from flowing into a channel and an open position to allow fluid flowing into the channel;

providing a bias member to bias the valve member to the open position; and providing a scuttle washer sandwiched between the end member and the valve member, the scuttle washer comprising a material that dissolves due to exposure to sea water without generating toxic gas or hydrogen.

12. The method according to claim 11, wherein the valve member include a series of legs to promote movement of the valve member and the scuttle washer along a longitudinal axis.

13. The method according to claim 12, wherein the channel has a head portion that is wider than an inner portion, wherein the legs promote movement of the valve member along a longitudinal axis of the assembly as the valve member moves to the open position.

14. The method according to claim 1, wherein the valve member includes a series of apertures to allow water flow.

15. The method according to claim 11, wherein valve member includes an end having a boss.

16. The method according to claim 15, wherein the end member includes a depression to capture the boss when the scuttle washer is dissolved.

17. A submarine launch vehicle system, comprising:

an inflatable bag;

a buoy; and a float assembly comprising a scuttle mechanism including:

an end member having a port to enable fluid flow;

a valve member having a closed position to prevent fluid from flowing into a channel and an open position to allow fluid flowing into the channel;

a bias member to bias the valve member to the open position; and a scuttle washer sandwiched between the end member and the valve member, the scuttle washer comprising a material that dissolves due to exposure to sea water without generating toxic gas or hydrogen.

18. The system according to claim 17, wherein the valve member include a series of legs to promote movement of the valve member and the scuttle washer along a longitudinal axis.

19. The system according to claim 17, wherein valve member includes an end having a boss.

* * * * *